United States Patent [19]

Whittaker et al.

[11] 4,227,385

[45] Oct. 14, 1980

[54] STRAIGHT BAR KNITTING MACHINES

[75] Inventors: Leonard B. Whittaker, Desford; William Clayton, Leicester; Eric W. Marriott, Shepshed; Barry C. Strong, Syston, all of England

[73] Assignee: William Cotton Limited, Leicestershire, England

[21] Appl. No.: 3,731

[22] Filed: Jan. 15, 1979

[30] Foreign Application Priority Data

Jan. 17, 1978 [GB] United Kingdom ..... 1735/78

[51] Int. Cl.[2] ..... D04B 11/00; D04B 21/00

[52] U.S. Cl. ..... 66/82 R

[58] Field of Search ..... 66/82 R, 82 A, 88

[56] References Cited

U.S. PATENT DOCUMENTS

| | | | |
|---|---|---|---|
| 2,363,008 | 11/1944 | Lamback | 66/82 R |
| 3,287,936 | 11/1966 | Bentley | 66/82 R |
| 3,397,555 | 8/1968 | Blood et al. | 66/88 |
| 3,435,637 | 4/1969 | Wholton et al. | 66/82 R |

*Primary Examiner*—Ronald Feldbaum

*Attorney, Agent, or Firm*—Robert E. Burns; Emmanuel J. Lobato; Bruce L. Adams

[57] ABSTRACT

A straight bar knitting machine has pivots and levers for operating different reciprocable bars (such as needle bar, knockover bar and catch bar) arranged in a novel configuration wherein most levers extend from a longitudinally arranged pivot area to locate in a longitudinal substantial L-shaped zone and these levers are connected by links to the reciprocable bar or bars to form fabric in a zone substantially diagonally opposite the pivot area formed by the levers and the links when seen from the side. The configuration in a preferred embodiment has separate cams and cam shafts below and behind the L-shaped zone and for greater compactness a pair of fabric forming zones may be arranged back to back on a single machine with a common cam shaft arranged between the respective L-shaped cones associated with the fabric forming zones.

12 Claims, 23 Drawing Figures

STRAIGHT BAR KNITTING MACHINES

DESCRIPTION

Field of the Invention

The invention relates to straight bar knitting machines and more particularly the actuation of different knitting instrumentalities.

BACKGROUND OF THE INVENTION

Prior Art

Straight bar knitting machines have had, since the inception of the Cotton's Patent machines in the 1860's (see British patent specification Nos. 3123 of 1864) the same overall configuration with only small variations. In the most common multi-section straight bar machines of the Cotton's Patent type a composite movement is imparted to the needle bar by upper levers pivotably fastened to each end of the needle bar to support the needle bar and provide an up-down motion therefor and by an upright support arm conjointly pivotable with the needle bar to provide an in-out swinging motion. The motions are produced from cams on a single rotatable cam shaft which cams engage levers secured to longitudinally extending shafts mounting the up-down levers or an in-out lever which operated a lower link connected to the aforesaid support arm. From the side the levers, support arms and links have the appearance of a quadrangle with the longitudinal shafts at one upper corner, the needle bar outside the quadrangle at another upper corner and the cams below the quadrangle. When seen from the front the levers, support arms and links are spaced apart by mounting them at different parts of the longitudinal shafts so that one cam could serve a number of levers. Actuating mechanisms for catch bars and knockover bars and any other mechanisms added in the course of time were mounted on the machine using similar longitudinally extending shafts (see for example U.S. Pat. No. 3,397,555).

In a less commonly used single section straight bar knitting machine (see British patent specification Nos. 411,517 and 867,391) the basic needle bar actuation mechanism was not altered. Longitudinal shafts were grouped more closely together and certain parts of added rib-knitting mechanisms were actuated by separate cams one at each side of the single section.

The Pourchot British patent specification No. 643,624 shows a common longitudinally extending shaft for the levers and the single cam shaft located inside the aforesaid quadrangular arrangement, but does not provide an adequate pressing of the needle beards or hooks (to close them prior to knockover) because the needle bar is pulled into press by a spring, and the needle bar projects upward of the quadrangular arrangement so detracting from constructional rigidity.

The long path through which force was transmitted from the cams, to a lever, to a longitudinal shaft and then through lever and optionally links and support arms to the needle bar restricted the directness of needle bar actuation, its rigidity and its ability to operate at speed. Similar actuation arrangements for the other motions provided the same type of difficulty. The floor area occupied was generally considerable.

To combine the various actuation components it was generally necessary to make them of different shape, length or size so that the value of components stocked for producing the straight bar machines and for maintaining them was high.

These factors (the difficulty of incorporating additional components and the manufacturing cost) combined so that the machines had only a limited potential for further development, be it development for increasing production speed or for performing additional functions or performing more flexibly.

Furthermore the knitting head on known machines itself it not well arranged for compactness or high speed operation. Slurcock noise and jackwear increase sharply at higher speeds and the knockover bar, which is squeezed between the needle bar and sinker bar, tends to bend at high speed or require considerable reinforcement to resist bending.

Even if a high speed operation were possible, the cam drive mechanism would cause the followers to jump off the cam at cam peaks so destroying the accurate control over the different motions.

The draw mechanism generally employs rigid rods friction boxes and slur bars which occupy considerable space and do not lend themselves to high speed operation. Endless band mechanisms developed as an alternative lead to breakage and occupy space at the rear of the knitting head.

It is the object of this invention firstly to provide a novel straight bar machine configuration which avoids or mitigates the restrictions inherent in the known Cotton's Patent type machine and has development potential. It is another object to provide a machine including a suitably arranged knitting head capable of high knitting speeds. It is another object to provide a compact machine which can be operated at high speed and/or make effective use of floor space. It is another object of the invention to provide a knitting machine using standardised actuation mechanisms for the different components.

DESCRIPTION OF INVENTION

The foremost change introduced by the invention with respect to the existing machines lies in the totality of the arrangements for imparting motion to knitting instrumentalities operating in the knitting head. As with the known machines, shafts levers and links are used but the overall arrangement thereof is remarkably different. This difference cannot be attributed to the use of any single new component or the change in any single bar motion although numerous changes have been made in individual motions as subsequent developments of the overall arrangement as will emerge. There are many ways of highlighting the distinction. The invention is perhaps best characterised by the fact that levers for a predominant number of motions of the knitting instrumentalities extend from a longitudinally arranged pivot area to locate in a longitudinal substantially L-shaped zone and are connected by links directly or indirectly to the respective movable bar or bars to form fabric in a zone substantially diagonally opposite the aforesaid pivot area in quadrangular configurations formed by the respective levers and links when seen from the side. Such arrangements, where adopted for needle bar and knockover bar motions, differ markedly from conventional needle bar and knockover bar actuation arrangements.

In the invention thus the levers, links and pivots for the levers occupy distinct zones, are arranged in an orderly manner and do not intermingle. Using the invention, similar mechanisms can be used for the motions of the different knitting instrumentalities and bars mounting the instrumentalities including similar mechanisms for up-down as well as in-out motions. The use of standardised levers becomes possible. The number of levers and links arranged in the orderly fashion of the invention can be varied. Other motions for fashioning for example can be arranged in a like manner. Using the invention certain motions may be arranged conventionally as the orderly arrangement of the invention permits a combination with such motions. However the arrangement of the invention is particularly advantageous because it enables a large number of motions to be effected in a similar, mutually compatible manner and recourse to conventional arrangements is rarely necessary.

The pivot area may comprise one or more lever pivots arranged closely together, or spaced apart at the diagonally opposite part of the rectangular configurations but generally the links connected to the levers and the bars are on one side of the L-shaped zone and lie substantially parallel. Indirect actuation may be provided by locating shafts which may be torque transmitting shafts substantially in or adjacent the knitting heads.

The actuation re-arrangement provided by the invention creates the conditions for further development of straight bar machines. By capitalizing on the simplicity and standardisation of the actuation arrangement, it may well become possible to reduce the manufacturing costs of a straight bar knitting machine section. The actuation arrangement could be used for single section or multi-section machines.

The invention can however be used very advantageously for single section machines which use a small number, preferably 1, of common lever shafts to pivotably support the levers and which use at least two sometimes more than two sets of levers and links to impart motion simultaneously to longitudinally spaced positions along the respective bar. The use of standardised actuation components compensates, at least to some extent, for the increased number of actuation lecers and links. It may thus be possible to provide a single section machine at a cost comparable to that of the average cost of a section of a multi-section machine and so provide greater flexibility in the manufacture, procurement and operation of straight bar knitting machines.

In the particular embodiment described with reference to the drawings, the invention has been further developed to provide a straight bar knitting machine capable of knitting speeds in excess of those possible up to now. The various developments of the invention now discussed relate to features which assist high speed operation but which may also be useful to achieve a compact construction, reduce cost and improve functioning of the machine even when working at conventional speeds.

Preferably a mechanism for sequentially advancing sinkers is arranged to extent lengthwise through the respective quandrangular configurations and along the rear of the knitting head, a head rail for mounting the sinker bar being located between the fabric formation zone and the pivot zone. Thus a very compact arrangement results whereby the orderly arrangement of the invention is maintained. Seen from the side of the machine the quadrangular configuration and the knitting head (including the needle bar but excluding any optional rib knitting attachment) overlap. Only the catch bar in conventional machines is arranged in a manner which resembles in any way the arrangement which here is adopted generally for the knitting instrumentalities. As many lever and links will operate over the head rail, it has been found advantageous to arrange and construct the respective actuation mechanism so as to permit their close packing at the ends of the knitting head as will be explained in more detail later.

In the compact arrangement, the needle bar may be directly actuated so that the needle bar is pulled into press by an in-out link extending from the needle bar to a position behind the knitting head. The link which extends generally horizontally does not support the needle bar weight whereas the generally horizontal up-down lever arm of the prior art arrangements was the main needle bar support. To maintain positive control over the needles as they are pulled into press (that is to say to press the beards of the needles against the needle stems) guide plates may confine the needle bar against longitudinal end-wise play. Preferably the needle bar is supported by an up-down arm at each end of the needle bar and the up-down arms are each pivotably connected to in-out pulling links. Thus the in-out link motion is imparted simultaneously to each end of the needle bar enabling larger forces to be applied to the needle bar for pressing.

The use and arrangement of the in-out pulling link helps to achieve high speed operation as it is light yet permits a direct transmission of considerable forces without significant distortion. The reciprocal motion of the needle bar can be achieved whilst reciprocating a relatively light actuation arrangement. Using the direct needle bar actuation, the in-out levers are preferably operated at a leverage (ratio of a cam follower lever pivot distance to link attachment-lever pivot distance) of approximately one.

Conveniently the needle bar is secured to the up-down arms between their pivotal connection with the in-out links and their pivotal connections with the up-down actuating levers so that the needle beards are in line with the in-out links. The needle bar is thus not cantilevered and supported mainly from below. The actuating levers have fixed pivots at a corner of the quadrangle opposite to that at which the needle tips are located. This arrangement of the various components improves access to the knitting head from above and from the front. Knockover bar and catch bar motions can be arranged analogous to the needle bar motion, giving a very compact actuating arrangement with short force transmission paths suitable for high speed operation and at the same time the use of standardardized levers. Space remains available firstly below the L-shaped area for drive components such as cams but importantly remains also available behind the knitting head.

The actuating mechanisms for the different motions may be duplicated at each end, and the number of longitudinally extending pivotable shafts outside the knitting head may be reduced or the use of such shafts may be avoided altogether. Links and support arms, also having their own actuating mechanisms such as levers and cams, may be provided at an intermediate position along the head rail, such as for example an up-down needle bar arm or an in-out catch bar arm. Some links and arms however lie on an extension of the path of the yarn carrier or fabric take down path and these should be confined to the sides of the needle bar. Thus the in-out needle bar links are only provided at each end of the needle bar and the catch bar up-down arms similarly only at each end of the catch bar. By suitable arrangement and eesign of the links, arms and levers, the amount of space obstructed by the links which define the ends of the useful knitting area can be kept small. The needle bar may be provided with a reinforcement flange for increasing its resistance to deformation when it is pulled at its ends only into press. Preferably the reinforcement flange is at the rear of the needle bar (i.e. on the side of the needles opposite to that with the needle beards) at a level adjacent the needle seating. This surprisingly enhances the needle bar stability considerably so that higher knitting speeds become possible (other mechanisms permitting) or longer needle bars can be used.

Advantageously the flange is adapted to increase its rigidity, especially against deformation in a plain parallel to the in-out links. Such adaptation may be further improved if required by incorporating high tensile strength material such as carbon fibres into the reinforcement flange. The carbon fibre may be in the form of a strip embedded in a groove or recess in the top and/or bottom surface of the flange. Using such a needle bar high rigidity and low mass can be achieved so facilitating high speed needle bar reciprocation and accurate, undistorted needle movement along the length of the needle bar.

Knitting speeds are also limited because of cam followers jumping off their cams. Preferably therefore the actuation and drive arrangement of the knitting machines of the invention is modified to use cams to generate movement of the links and support arms in both directions of their reciprocation. Advantageously the actuating levers are bell crank levers operated by cams of the desmadromic type. Preferably a pair of cam shafts is used so as to provide the space for the double set of cams for each motion. Suitably one cam shaft is located behind the actuating levers for the in-out links so as to operate these links very directly. By suitable design the cam packs and levers can occupy only a small port of the machine yet provide efficient high speed actuation of the different levers and support arms. The location of a cam shaft behind the quadrangular lever-link configuration is only possible because of the orderly actuation arrangement of the invention and provides a very much more direct force transmission path than with the Pourchot British patent specification No. 643,324.

In a further preferred form of the invention, the knitting machine of the invention has a knitting section with a pair of knitting heads arranged back to back and driven by one drive shaft extending longitudinally between the knitting heads. In this way drive and actuation mechanisms are shared between a pair of knitting heads, the floor area occupied for every productive knitting head is reduced vibrations may be reduced by the oppositely directed, simultaneously occurring needle bar movements. A high fabric production per floor area and capital invested may be obtained in spite of the fact that only a single section is provided by each knitting machine.

In the different Figures only those parts relevant and illustrated by the Figure concerned are shown for clarity.

DETAILED DESCRIPTION OF A BACK TO BACK MACHINE

Carcas

Figure 1:
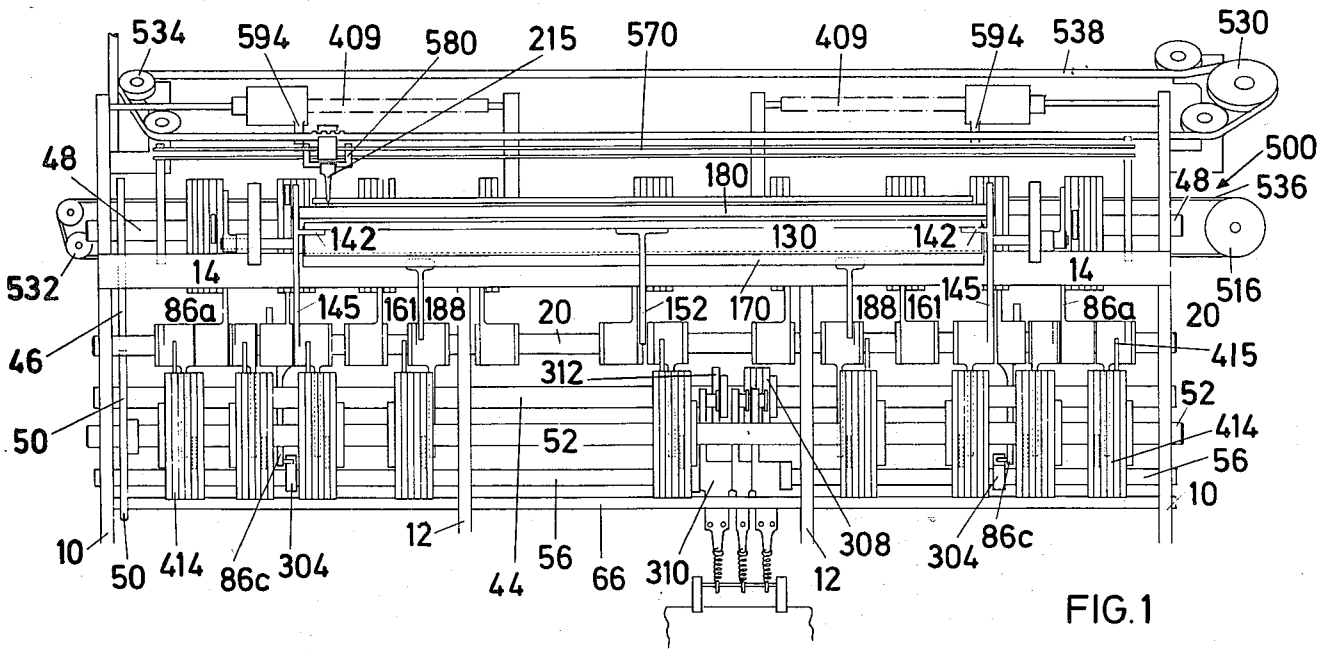
FIG. 1 is a front view (the rear view is the same) showing schematically the parts of a straight bar knitting machine of the invention, having a single yarn carrier, between end standards thereof.
Figure 2:
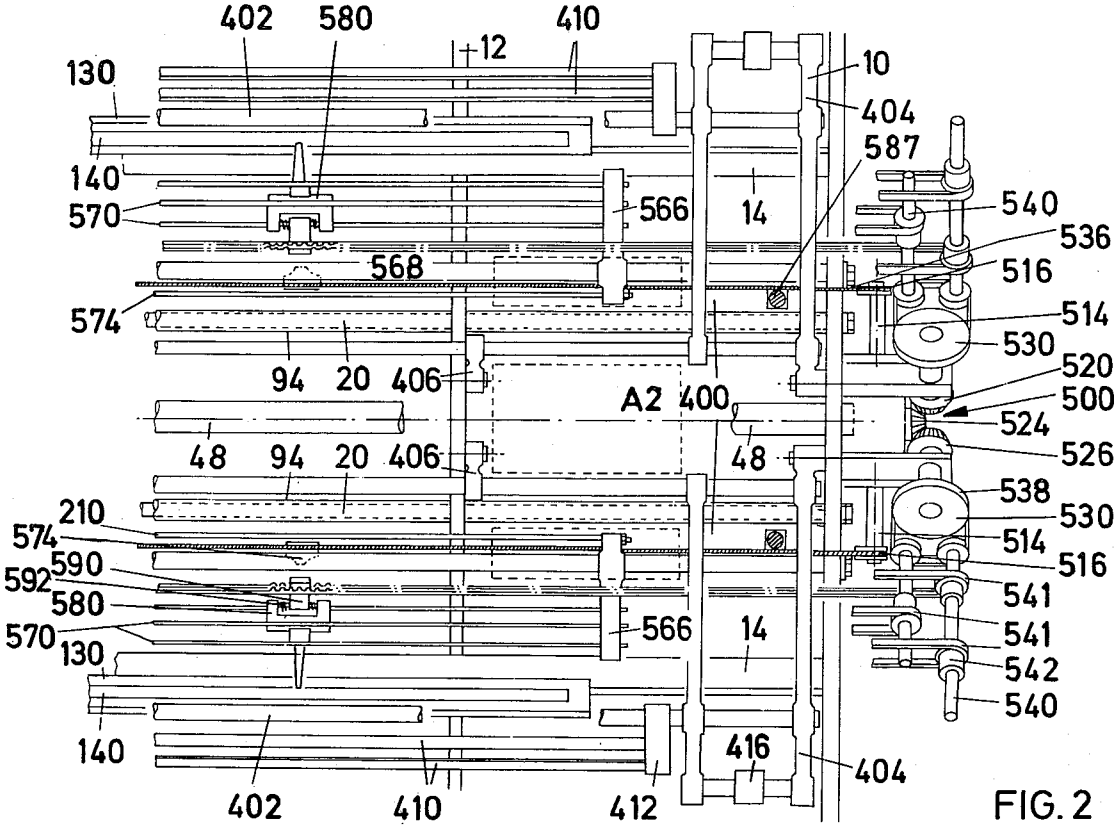
FIG. 2 is a schematic view from above of part of the machine of FIG. 1 but having three selectively operable yarn carriers and showing main mounting components.
Figure 4:
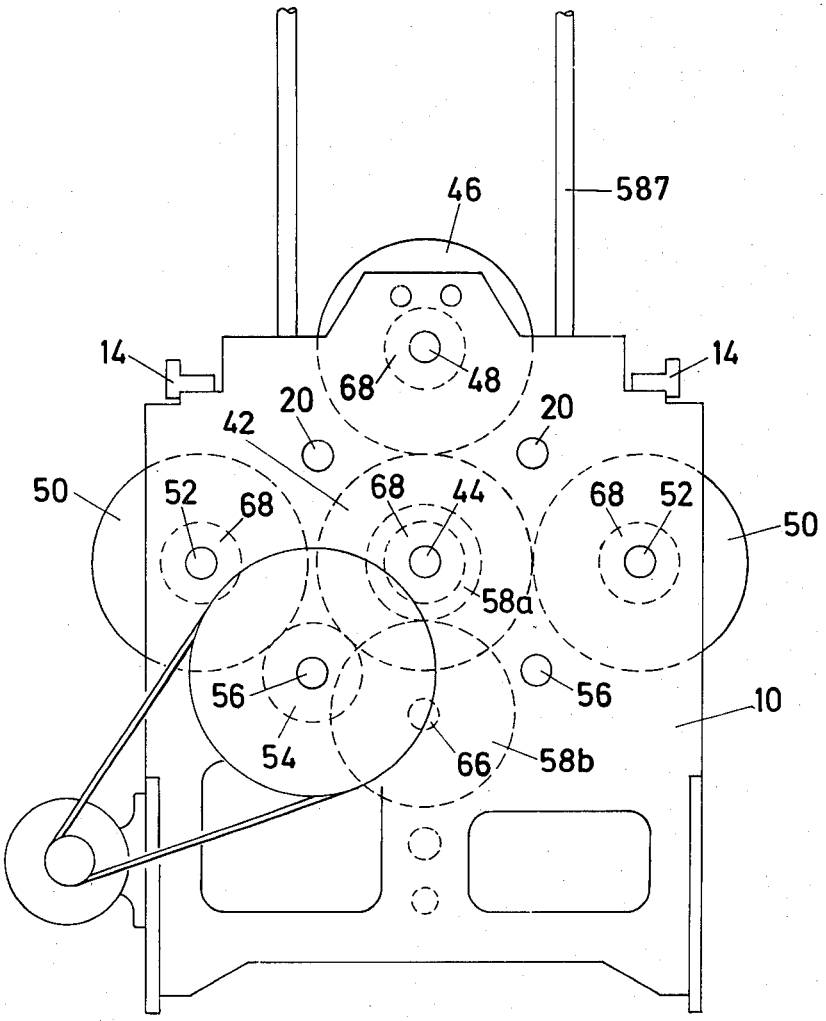
FIG. 4 is an end view from the left in FIG. 1 of the carcass of the machine of FIG. 1 and FIG. 2.

The only significant difference between the machines in FIG. 1 and FIG. 2 lies in the number of yarn carriers and are identical otherwise. With reference particularly to FIG. 1, FIG. 2 and FIG. 4, a carcass or frame of a straight bar knitting machine according to the invention has transverse end standards 10 and intermediate standards 12 which standards are all interconnected by a pair of longitudinally extending head rails 14 and a pair of lower rails 16. A middle rail may be added between the lower rails 16. Rods 20 (FIG. 2) extend between the end standards 10 to which they are secured by nuts. Sleeves 94 are mounted on the rods between the standards and levers 86 are freely pivotable between pairs of collars secured to the sleeves 94. The pair of head rails each support a knitting head. The components of the different knitting heads are the same and they perform the same operation at the same time.

Drive

Figure 9:
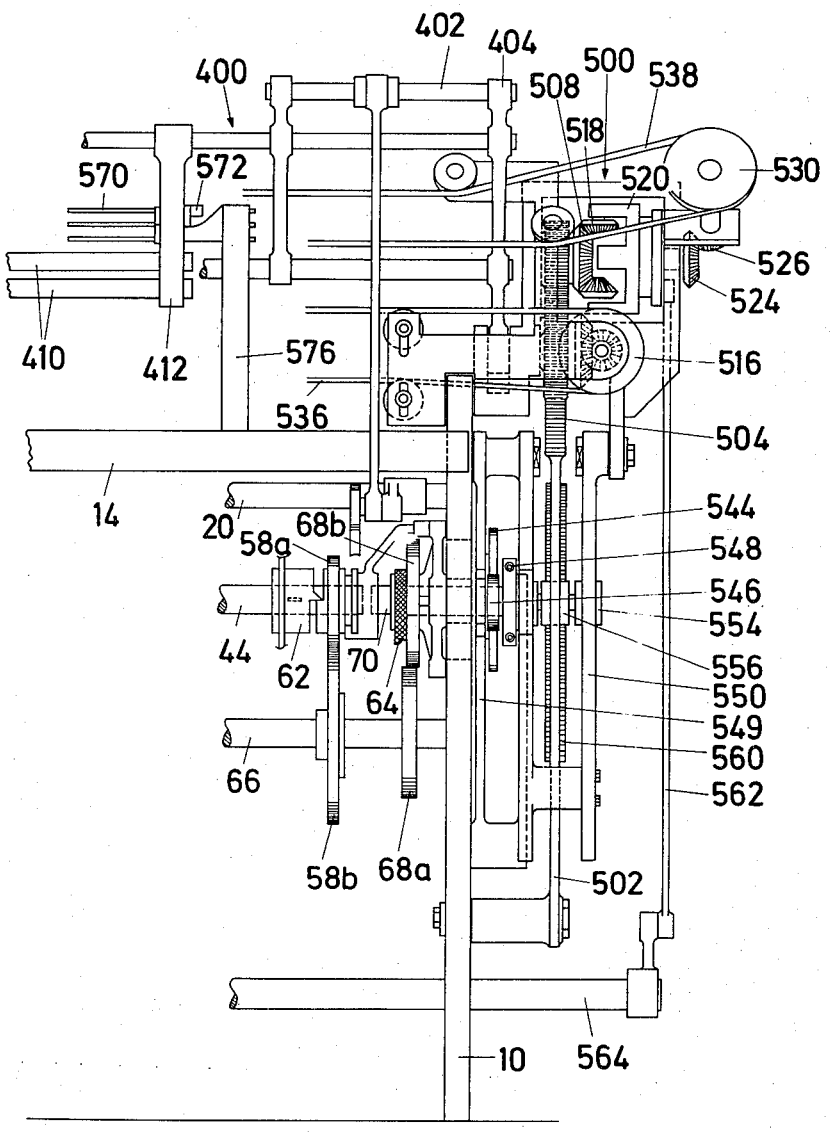
FIG. 9 is a detailed front view, partly broken away, of the portion of FIG. 1 at the right hand end adjacent the portion shown in FIG. 8.
Figure 10:
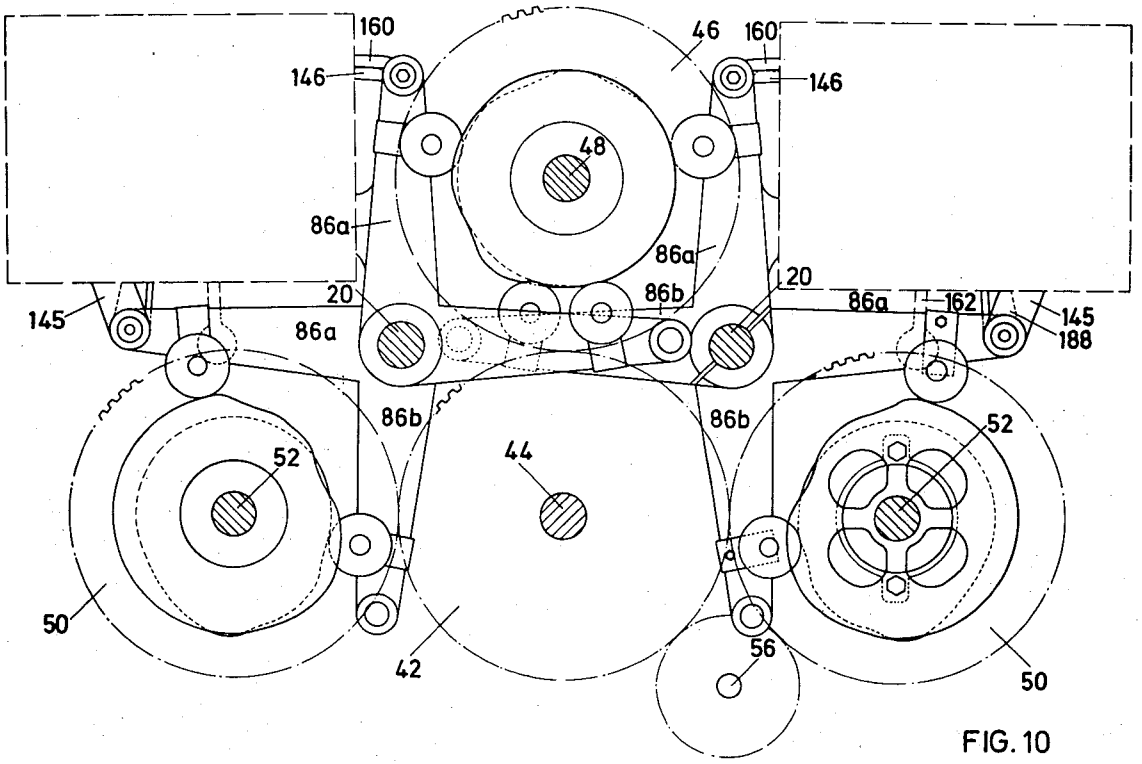
FIG. 10 is a schematic transverse section through the top of the machine of FIG. 1 and FIG. 2 whilst

With reference particularly to FIGS. 4 and 9, a motor is secured to one end-standard 10 to the left hand side in FIG. 1 and drives an input gear 54. A sun gear 42, mounted on a full speed shaft 44 received in bearings 68 in the standards 10 and 12 (shown slightly below its proper position in FIG. 1 for illustrative purposes) meshes with the input gear 54. The sun gear 42 in turn meshes with:

(a) a top planet gear 46 and a top cam shaft 48 received in bearings 68 in the standards 10 and 12; and (b) one bottom planet gear 50 on a bottom cam shaft 52 received in bearings 68 in the standards.

The gear 54 is rotatable on an axis 56 on a stubshaft and meshes with another bottom planet gear 50. This other planet gear is similarly mounted as the former planet gear 50 but rotates in the opposite direction.

The cam shafts 48 and 52 can be shifted longitudinally at the same time by cam shaft shogging mechanisms located inside cover 51 on the left hand side of the machine as seen in FIG. 1 to transfer control of the different knitting motions from one set of cams to another set of cams.

The shogging mechanism operates analogously to known shogging devices using selecting props for projecting plungers into face cams in cam shafts except that in this case each shaft has a face cam and three plungers are provided for being projected simultaneously to shog the cam shafts axially.

The full speed shaft 44 is drivingly connected (FIG. 9) through a clutch 62 and reduction gears 58*a* and 58*b* to a half speed shaft 66 (See FIG. 9). A gear 68*a*, driven from the shaft 66, meshes with a gear 68*b* on the draw cam shaft 70 which shaft is mounted on the same centre line as shaft 44, thus providing a half speed to the draw cam 544. A leather belt 64 is brought into contact with a boss on gear 68*b* by means of mechanism (not shown) to act as a brake on the draw cam, prior to disengagement of the clutch. The half speed shaft 66 serves to operate the draw mechanism.

The drive described so far serves to operate the knitting and draw mechanism for the knitting heads on each of the head rails 14. The full speed shaft 44 serves to rotate the cam shafts 48 and 52 at the same speed as the shaft 44. The cams on these shafts 48 and 52 are generally used to operate levers for controlling different transversely movable bars of the knitting heads. The shaft 44 also serves to rotate a further cam by way of the half speed shaft 66 which operates the draw mechanism described subsequently.

Cams and Levers

Figure 17:
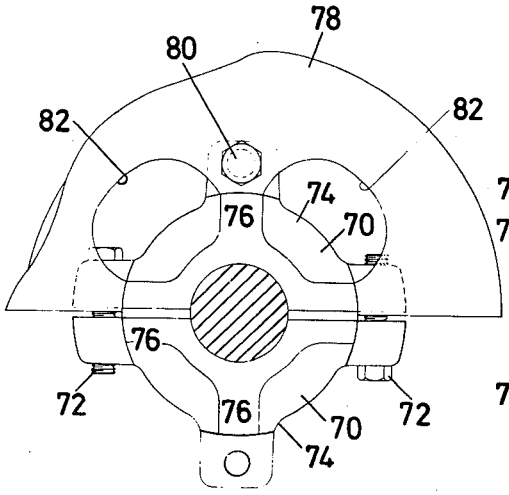
FIG. 17 is a side view of a partially assembled cam pack of the machine of FIGS. 1 and 2 and FIG. 18 a front view.
Figure 18:
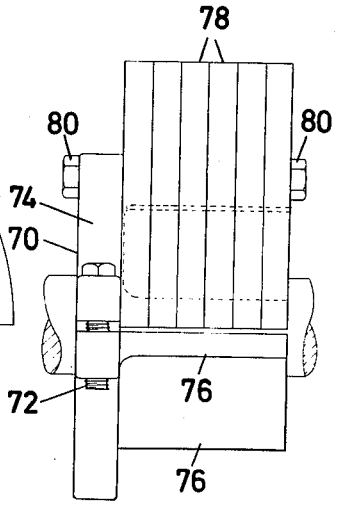

Cams for operating the different transversely movable bars are arranged in packs on the cam shafts 48 and 52. The cam shaft 48 supports two sets of packs, one for each of the knitting heads. Each pack is located on a hub comprising (see FIG. 17 and FIG. 18) two hub halves 70 secured together at one end by bolts 72 passed through projections at a locating rim 74. Each hub half 70 has three radially projecting ridges 76 for supporting cam halves 78 fastened together in a pack and secured by bolts 80 to a further projection from the locating rim 74. The cam halves 78 have cut-away central portions 82 to reduce their mass. The cam halves 78 are thus closely adjacent. The cam pack assembly can be easily dismantled without disturbing any adjacent cam packs.

Figure 15:
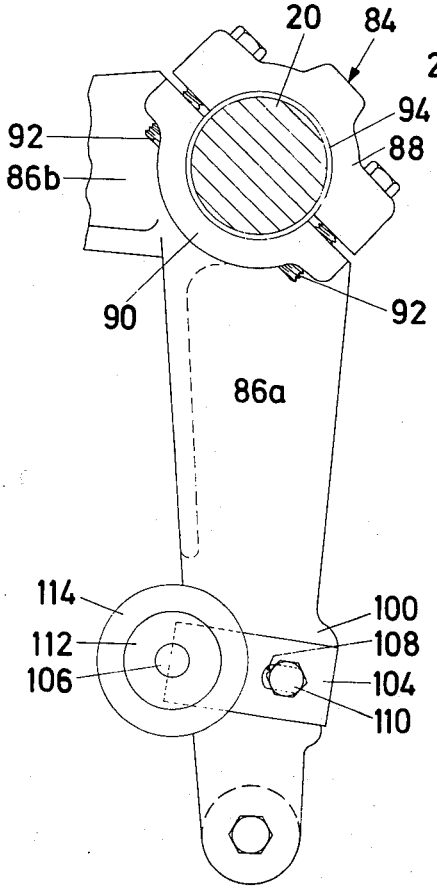
FIG. 15 is a side view of a lever of the machine of FIGS. 1 and 2 and FIG. 16 a front view showing adjacent parts.
Figure 16:
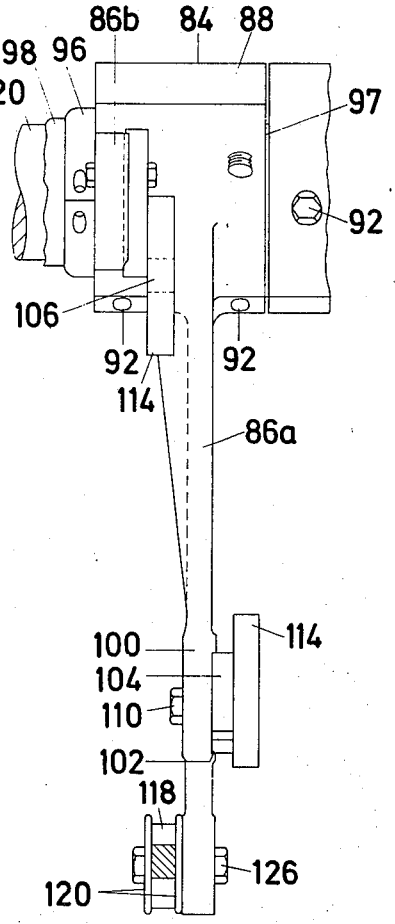

Each cam pack is associated with a particular lever. The levers operated by the cam packs on the shafts 48 and 52 are arranged in rows on the lever shafts 20. Each lever (See FIG. 15 and FIG. 16) has a hub 84 and a pair of lever arms 86*a* and 86*b*. The hub 84 is constituted by a fastening half section 88, and a lever arm carrying half section 90. Bolts 92 hold the sections 88 and 90 together. The hub 84 is mounted on a bearing sleeve 94 surrounding the shaft 20 and is held against lengthwise movement by locating rings 96 and spacing sleeves 98. The hub 84 may bear against a shim 97 spacing two adjacent levers. Both arms 86*a* and 86*b* have a thickened arm portion 100 with an aperture 102 (not shown).

The cam followers can be made to follow the cam contour accurately by adjusting the position of the mounting plates 104 with respect to the arms 86 using the bolts 110.

For standardisation purposes levers may be produced in right or left hand versions which are dimensionally the same. Portions 102 may be milled on the left or right hand side of the arms 86*a* and 86*b* and fitted with mounting plates 104 with a spigot 106 carrying cam followers as appropriate, giving a total of four different lever configurations.

The spigot 106 is cutaway under the plate 104 to provide a straight lower edge for the plate 104.

The cam followers, which may include balls in a ball race, has a thin cross section and can follow a cam surface even though cam surfaces on either side thereof are raised.

Links or connecting arms 118 may be pivotably secured to the end of the arms 86*a* by means of pivotal connections with bearings.

It is a significant feature of the invention that such standardised cam pack, lever, connecting arm and link arrangements be used for most motions of the transversely movable bars of the knitting head and possibly also for other cam controlled operations such as fashioning and lead screw racking. In the following, the individual bars will be described with only brief references to the lever cam and link arrangement which is generally as that described here. However where appropriate a single lever arm may be used for certain levers with spring return where this can be done without disturbing jumping of follower off cams. Also instead of the half section 88 another section can be used having a single lever arm in the case of the levers for the needle bar in-out motion (see FIG. 7).

Knitting Head

With reference particularly to FIGS. 7 to 12 each knitting head includes a needle bar 130 comprising a needle bed 132 which cooperates with clamps 132*a* at its front to fix sets of bearded needles. A flange 134 is formed integrally with the bed 132 from aluminium at the rear of the bed 132 and at the level of the clamped needle portions. Carbon fibre reinforcement strips 140 are bonded to the aluminium in shallow grooves formed in the flange 134.

The bar is secured at each end to mounting brackets 142 located under the flange 134 by means of bolts 138. The brackets 142 are welded at an intermediate position to rigid up-down connecting arms 145. Guide plates 148 fastened to the hear rail 14 prevent sideways movement of the needle bar connecting arms 145 allowing only in-out and up-down movement.

The up-down connection arms 145 are pivotably connected at the top to in-out links 146 at a position above the needle bar 130 and in line with the row formed by the needle beards. The links 146 pass over the top of head rail 14 and are each operated simultaneously by upright lever arm 86*a* behind the knitting head of similar lever to pull the needle bar 130 into press moving it towards the head rail 14 under the influence of cam pack arrangements at each end of the needle bar 130. The up-down arms 145 are pivotably connected at the bottom to up-down lever arms 86'*a* which are at a level below the knitting head and pass under the head rail 14 substantially parallel to the links 146. The needle bar 130 is supported between its ends by an intermediate arm 152 (FIG. 1). The different lever arms are all mounted on the lever shaft 20.

Figure 7:
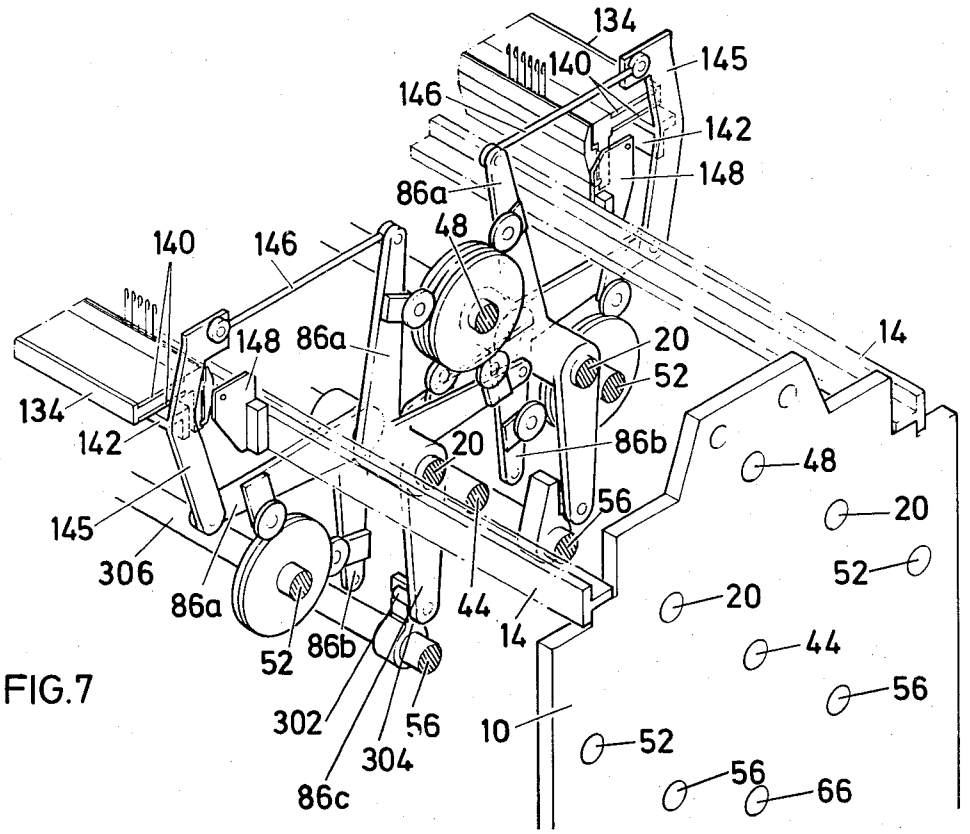
FIG. 7 is a perspective view, partly broken away, of parts of the knitting machine of FIGS. 1 and 2 for actuating needle bars.
Figure 11:
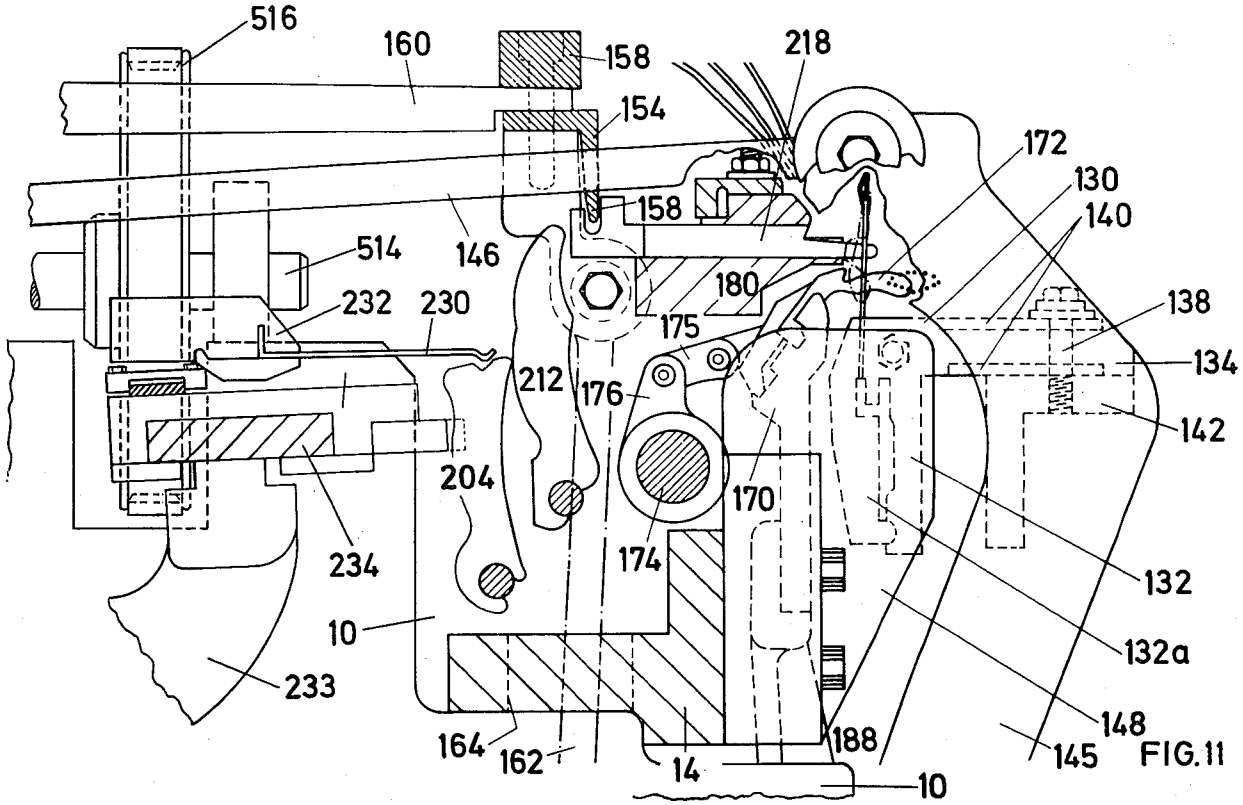
FIG. 11 shows part of FIG. 10 which is blank suitably enlarged in a partly cut away section.

With reference particularly to FIGS. 7 and 11, it can be seen how the overall effect is that each end of each needle bar is mounted by a rectangular lever, connecting arm and link arrangement with the rows of needle beards adjacent an outer and upper corner and with the lever shafts 20 at the inner and lower corner. Both the rows of needle beards and the head rails 14 and associated sinker bars are on a diagonal line between these aforementioned corners. The overall rectangular lever link arrangement and the needle bar and knitting head which occupy part of the cross-sectional area within the lever-link arrangement, is very compact and the top cam shaft 48 can be accommodated between two symmetrically arranged lever-link arrangements for direct transmission of cam follower movement to the needle bar. The front and rear needle bars 130 are longitudinally off-set so that each are operated directly by cam packs arranged side by side on the top cam shaft 48. Space remains below each of the knitting heads for the further bottom cam shafts 52 and cam packs and any other mechanisms. The needle bar is thus operated to cause the dip of the needles to follow the path shown chain dotted in FIG. 5B.

The needle bar 130 is controlled by a quality control mechanism during the draw cycle when the bar 130 is stationary whilst the new yarn is being laid in by the carrier and sinkers. The draw position can be varied by the quality control mechanism as follows.

The needle bar in-out levers have each a third lever arm 86C (FIG. 7) which carries a pin 302 for engaging a quality lever 304 on a quality shaft 306 on the axis 56, one shaft being provided for each knitting head. Linkages connect the quality shafts 306 to ensure their simultaneous movement. The cams on the shaft 48 for controlling the needle bar in-out motion during a knit cycle are cut away at the sector passing the cam followers during the draw cycle so as to give the levers freedom of motion and enable the needle bar to be set closer or further away from the head rail 14 to give the quality required. The quality shafts 306 are oscillated in synchronism with the rotation of the cam shaft 48 to give the desired quality or stitch length.

The movement of the quality control shafts 306 can be timed in the usual way by alternative cams 308 (FIG. 1) on the main drive shaft 44 which is not shogged to suit fashioning and normal knitting and the extent of the movement transmitted to both shafts 306 to suit fashioning and normal knitting can be set by alternative props (not shown) for the levers 310 engaging the cams. A cam 312 is provided to enable the appropriate props to be reselected. Once a prop is selected for a particular lever, that lever will impart a motion to the quality shaft of predetermined timing and extent.

Figure 8:
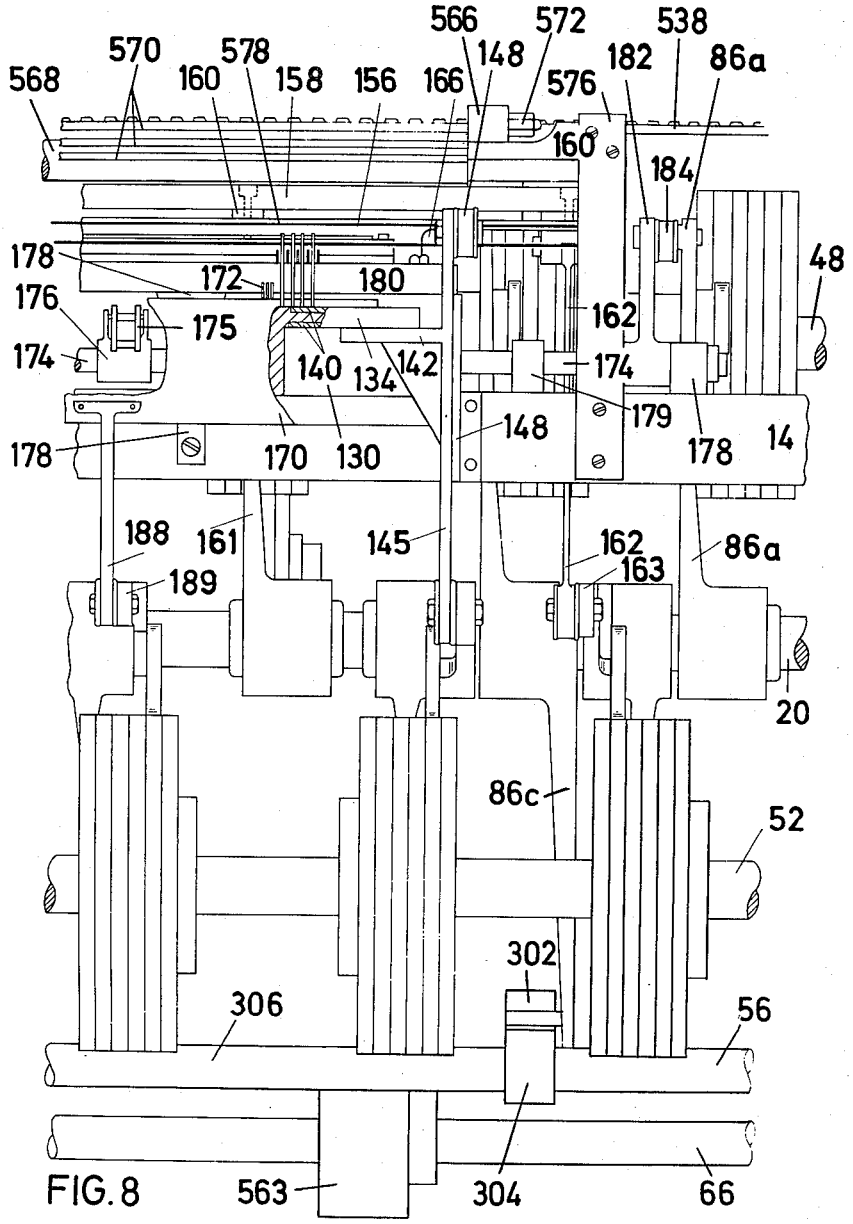
FIG. 8 is a detailed front view of the portion of FIG. 1 containing one end of a needle bar, the other end being symetrically arranged but otherwise the same.

With reference to FIGS. 8 and 11 each knitting head includes a catch bar 154 having a sinker butt engaging member 156 and a carbon fibre reinforcement strip 158. The catch bar 154 is supported by in-out connecting arms 160 at its ends and at intermediate positions. The arms 160 are not pivotable with respect to the catch bar 154. The catch bar 154 is further supported at its ends only by up-down connecting arms 162 passing through slots 164 in the head rail 14 arranged to the outside of the needle bar up-down arms 145. The member 156 is cut away at 166 to enable the catch bar 154 to fit closely over the needle bar in-out arms 146. The various connecting arms are secured to the ends of the lever arms as described previously. In FIG. 8, the in-out arm 160 is secured to an in-out lever arm 161 and the up-down connecting arm is secured to an up-down lever arm 163. The catch bar operates in the usual way for an all sinker machine.

With reference to FIGS. 8, 10, 11 and 12, each knitting head has a knockover bar assembly comprising a knockover bar 170 mounting knockover bits 172 and a torque shaft 174 extending alongside the rear of the knockover bar and connected thereto at a plurality of spaced positions by short links 175. The links 175 are of the kind used for chains and are pivoted on brackets on the bar 170 and brackets 176 on the shaft 174. The knockover bar 170 is supported from below between its ends by up-down connecting arms 188 pivoted on up-down lever arms 189 under the knitting head and attached directly to knockover bar 170.

The shaft 174 passes through bearings formed in nogs 178 bolted to the head rail 14 at their lower end and to a sinker bottom bar 180 at their upper end at intermediate positions and through bearing blocks 179 at the sides of the knitting head. The shaft 174 is thus located above the head rail 14 and the bearings restrain deformation of the shaft 174. At both ends the shaft 174 is connected to levers 182 pivotably mounted on in-out links 184 operated by upright in-out lever arms 86*a*. The levers 182, links 184 and lever arms 86*a* are located outside the control levers and links for the needle and catch bars.

The knockover bar 170 is flat and not likely to deform as a result of up-down motion. The short links 175, which are held against longitudinal movement with respect to the knockover bar in their brackets 176 firmly join the shaft 174 to the knockover bar 170. As the torque shaft 174 is held in bearings in the nogs 178, it thus holds the knockover bar against deformation resulting from in-out motion. The knockover bar assembly also permits the in-out motion to be created using the standardized cam packs, levers and links described. The resultant motion is illustrated by the dotted line in FIG. 11.

The machine illustrated in the Figures is a machine having progressively advanced jack operated sinkers only and no simultaneously advanced dividing sinkers. Thus a set of elements including a sinker, jacks, jack springs is aligned with each knockover bit 172 to advance the associated sinker between adjacent pair of needles in the needle bar 130.

Figures 12, 13:
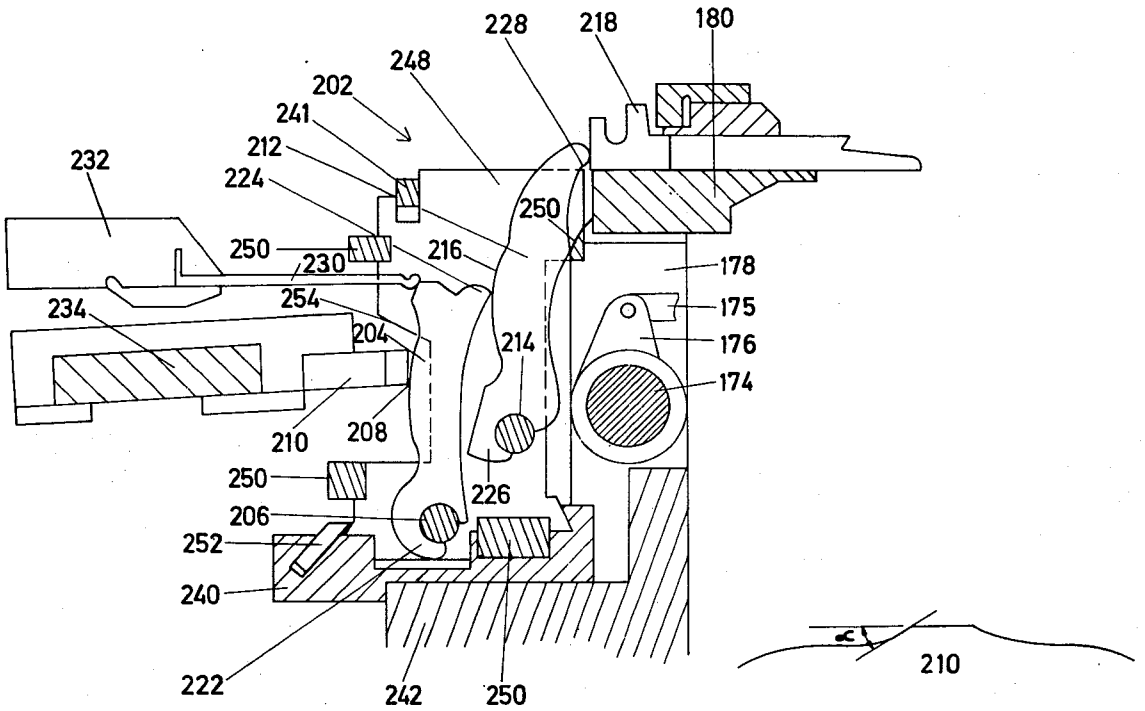
FIG. 12 shows part of FIG. 11 but in a different stage of sinker operation.
FIG. 13 shows a slurcock profile for advancing jacks shown in FIG. 11 and FIG. 12.

With reference to FIG. 12 a jack bar assembly, generally indicated at 202, has primary jacks 204 mounted on a longitudinally extending pivot wire 206. The jacks 204 have a rear edge forming a bulge at 208 engaged by a slurcock 210 on a slur bar 234 (see also FIG. 3). The assembly 202 further has secondary jacks 212 mounted on another longitudinally extending pivot wire 214. The jacks 212 have a rear edge with a curved part at 216. Each pair of associated primary and second jacks 204 and 212 cooperate to actuate a sinker 218 slidably mounted in the sinker bar 180.

The primary jacks 204 have pivot portions 222 with a central aperture for holding the pivot wire 206 at one end and noses 224 at the other end which bear against the curved parts 216 of the rear edges of the jacks 212 at the other end. The secondary jacks 212 have pivot portions 226 at one end and noses 228 for engaging the sinkers 218 at the other end. The noses 224 engage the curved parts 216 halfway between the ends of the jacks 212.

In this case a leverage of 3 is obtained that is the lift provided by the slurcock 210 is one third of the advance of the sinkers 218. The leverage may be varied if required by raising or lowering the slur bar 234 with respect to the primary jacks 204. FIG. 12 shows the sinkers in their advanced position. The slur bar 234 is mounted on levers by mountings 233. The levers for the front and rear knitting heads $H_1$ and $H_2$ (see FIG. 19) are actuated simultaneously and the slurbar movement at the front and rear head may be controlled through common cams on the shaft 48.

The high leverage can be obtained with a jac assembly of dimensions similar to conventional ones which use only one jack to actuate each sinker and have a leverage of about 2. The vertical spacing of the pivot wire 206 and 214, is only small as is the horizontal spacing between the pivot wire 206 and 214.

The primary jacks 204 have bevelled edges at angularly spaced positions along the top edges for engaging jack springs 230 in the forward position (see Figure) or in the retracted position (See FIG. 11). No shifting of the jack springs 230 in a horizontal sense is required. The jack springs are moved up and down at both front and rear knitting heads ($H_1mH_2$ (See FIG. 19) simultaneously and may be operated at front and rear head by means of common cams on the shaft 48 to raise and lower the jack springs 230 when required.

The jack bar assembly 202 can be compactly accommodated to the rear of the sinker bar 180, above the head rail 14 and in front of a jack spring bar 232 and the slur bar 234.

The jacks 204 and 212 can be retained in the jack bar assembly 202 in appropriate register with the sinkers 218 by a housing comprising a jack bar base 240 attached to the head rail 14, jack bar pillars (not shown) being provided at each end of the jack bar base 240. The jack pillars mount the ends of the pivot wires 206 and 214, alignment bars 241 and trick cut bars 250 which serve to locate one jack wall 248 between each pair of jacks 204 and 212. The jack walls 248 are held onto the base 240 by a clamping plate 252 and each have a recess 254 to enable the slurcock 210 to pass along the rear of the jacks 204.

The slurcock profile (adapted for a leverage of 3) is shown in FIG. 13. Using the high leverage, the slope $\alpha$ at the forward extremity of the slurcock 210, which is the steepest part of the profile, can be made small. The slurcock engages the jacks 204 about halfway between the pivot 214 and the nose 22.

Fashioning Head

Figure 3:
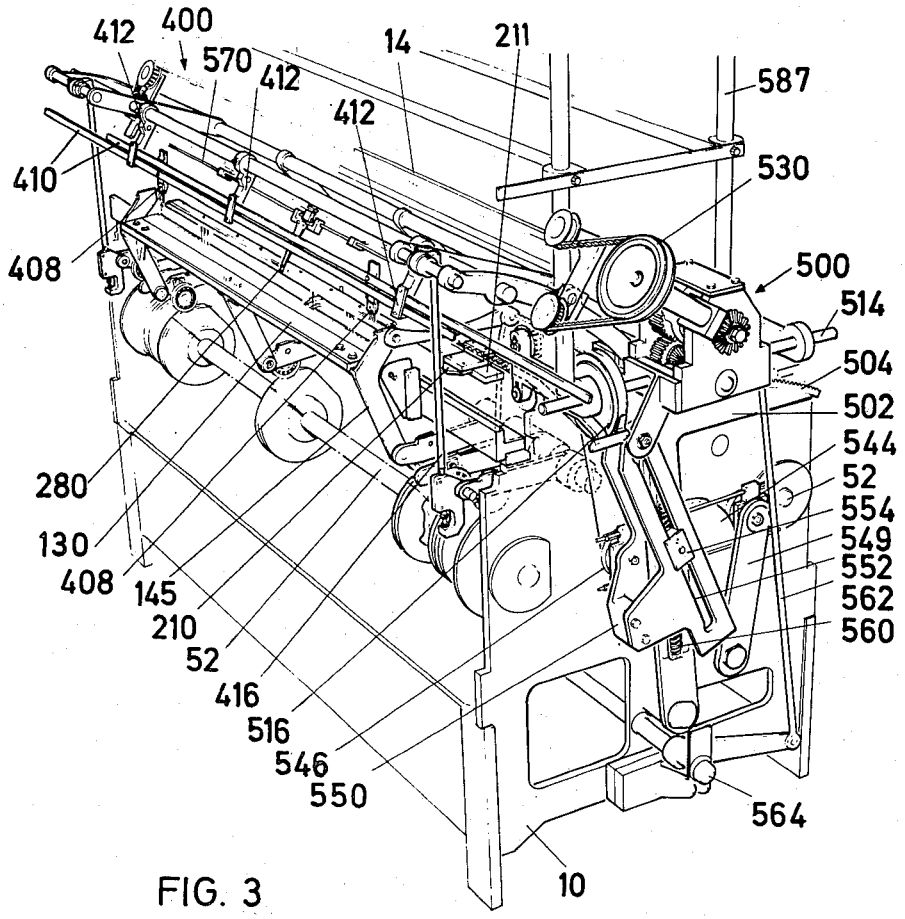
FIG. 3 is a perspective view of the knitting machine of FIG. 1.

With reference to FIGS. 2 and 3, each knitting head has associated therewith a fashioning head generally indicated at 400 (FIG. 3). Each head comprises (See FIG. 2) a fashioning frame 402 pivotably mounted for movement about an axis between the knitting heads on the sides using fashioning frame arms 404 and at intermediate positions through links 406. The fashioning frame 402 carries the usual fashioning points 408 (See FIG. 3) mounted on slide rods 410 in bearings 412. The points 408 can be shifted sideways by lead screws 409 (FIG. 1) operated by pawls (not shown) in the usual way in the course of a fashioning cycle. The parts associated with the lead screw for turning it are not shown for clarity and can be accommodated centrally between the knitting heads.

The fashioning frames are raised and lowered by cam packs 414 one at each end of the knitting machine through bell crank levers 41 and adjustable lifter rods 416 (shown in FIGS. 1 and 2).

Draw Mechanism

A draw mechanism is combined with the machine component previously described for laying in yarn during the draw cycle. The mechanism includes a differential 500 on the right hand side of FIG. 1. The differential 500 (See FIG. 6) receives an input from a quadrant gear 502 by means of teeth 504 thereon which meshes with an input pinion 506 in turn meshing with a differential pinion 508. The input pinion 506 also carries a first output bevel gear 510 meshing with a pair of bevel gears 512 (FIG. 5) to turn shafts 514 for rotating slurcock drive pulleys 516. The shafts 514 projecting in opposite directions turn in opposite senses. The differential input pinion 508 (FIG. 6) meshes with pinions 518 on a pinion cage 520 which is rotatably mounted around differential output pinion 522 fast to a second output bevel gear 524 meshing with a pair of bevel gears 526 to turn shafts 528 in opposite senses for rotating carrier drive pulleys 530. The pinion cage 520 is reciprocable to provide a subsidiary input which is superimposed on the input from the quadrant gear 502 to vary the rotation of the carrier drive pulleys 530 with respect to the slurcock drive pulleys 516.

The pulleys 516, 530 cooperate with freely rotatable pulleys 532, 534 on the left hand side of the machine as seen in FIG. 1 and guide flexible strongbelts 536, 538 to extend longitudinally along the knitting head. The belts are Uniroyal Internal tooth type belts known as HTD belts. The belts on the pulleys 530 may drive the carriers directly using a single carrier as in FIG. 1 and related Figures but the pulleys 530 preferably drive input shafts 540 (FIG. 2) for a plurality of alternatively operable carrier belts 541 mounted on pulleys 542. The belts can be selected for example by pneumatically operated clutches.

Figure 5:
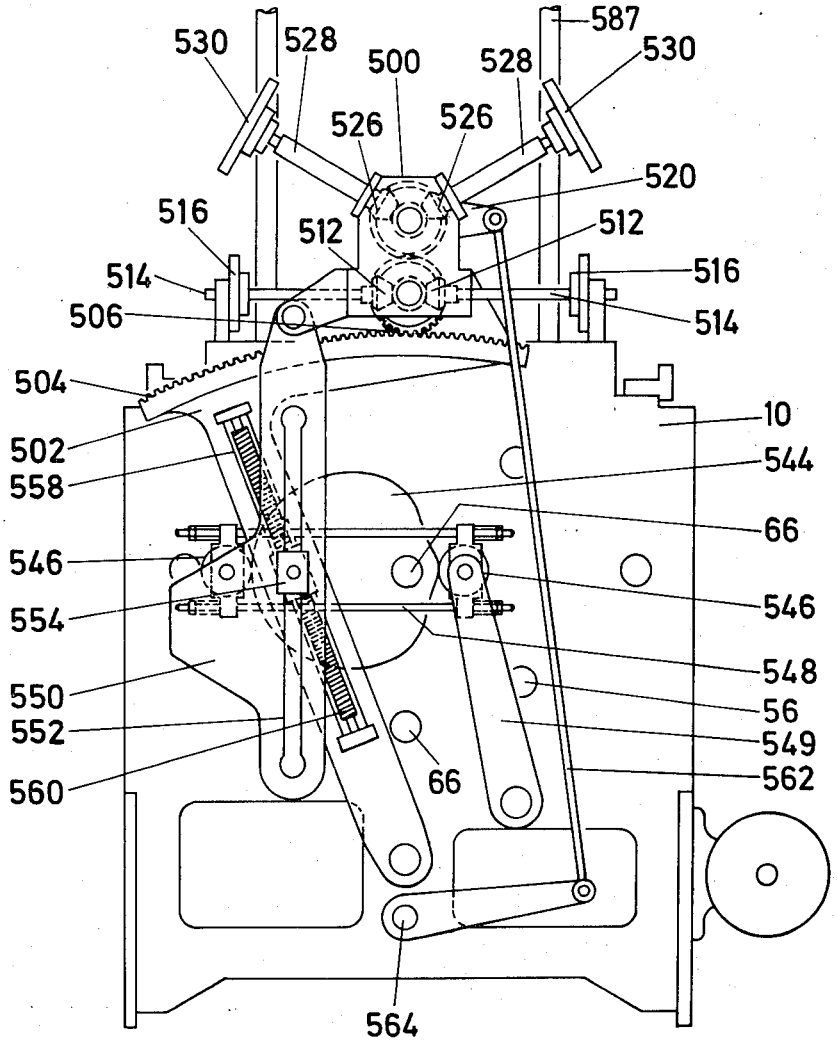
FIG. 5 is an end view from the right in FIG. 1 of the carcass and draw mechanism of the machine of FIG. 1 and FIG. 2.
Figure 6:
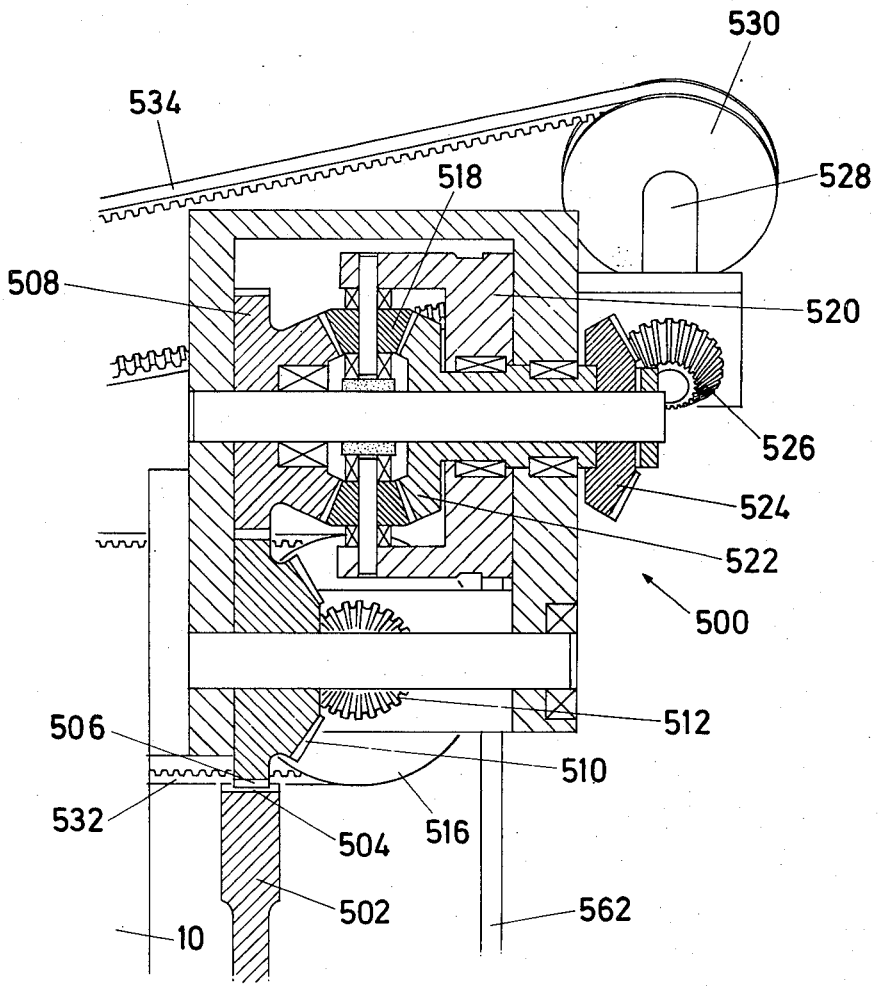
FIG. 6 is a section through a differential for the machine of FIGS. 1 and 2.

The quadrant gear 502 is arranged to provide a variable draw motion and input to the differential 500 (See FIGS. 3, 5 and 9). A draw cam 544 is mounted on the previously mentioned half-speed shaft 66 (FIG. 5) and engages cam follower rollers 546 mounted between tension rods 548 one on each side of the draw cam 544. One roller 546 is mounted on an upstanding primary lever 549 whilst the other roller 546 is mounted on a depending primary lever 50. As the cam 54 rotates the levers 549 and 550 are moved to and fro through a constant angle.

The lever 550 comprises a pair of parallel arms which each have a slot 552 mounting a connecting block 554 slidable in the slots 552. The blocks 554 mount between them a pivotable block 556 received in a slot 558 in the quadrant gear 502. A screw 560 extends longitudinally in the slot 558 and engages the block 556. The screw 560 can be turned controllably by bevels (not shown) arranged concentrically with the centre of the lever 502 to raise or lower the block 556 in the slot 558 so as to vary the leverage with which the primary lever 550 acts on the quadrant lever 502 and the arc through which the lever 502 pivots.

The pinion cage 520 is reciprocable by a rod 562 mounted on a shaft 564 (See FIGS. 5 and 9). The shaft 564 is oscillated by a lever (not shown) operated by a pack of cams 563 (See FIG. 8) on the aforesaid half speed shaft 66. By sliding the pack 563 axially, the timing of the oscillation of the shaft 564 is varied at the same time as the extent of the quadrant lever reciprocation is varied to ensure optimal slurcock/carrier operation at different draw widths as will be explained.

Figure 14:
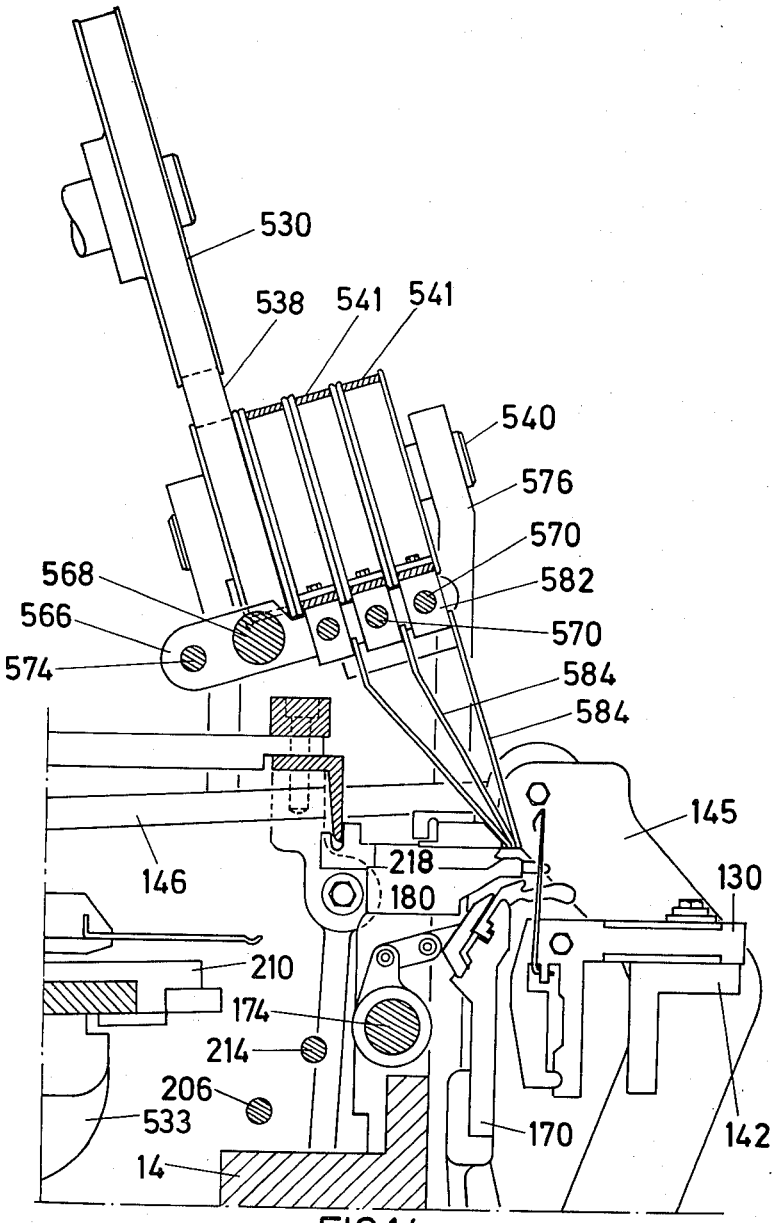
FIG. 14 shows a schematic transverse section through the top of the machine of FIG. 2.

The slurcock 210 is connected to the belt 536 (See FIGS. 2 and 3). The belt 536 passes over the end standards 10 but below the fashioning frame 402. The belt 538 or 541 for the carriers pass at least partly under the frame 402 and extend over a carrier guide rod assembly (See FIGS. 2, 8 and 14).

The carrier guide rod assembly comprises a pair of end brackets 566 spaced apart by a thick spacer rod 568. Between the end brackets 566 extend carrier guide rods 570 tensioned by nuts 572. The tension on the rods 570 is counterbalanced by countervailing tension applied to a rod 574. The assembly is bolted by arms 576 to the head rail 14 of the knitting machine. The arms 576 at the respective ends of the knitting head mount between them a set of guide wires 578 to confine the respective carriers 580 and avoid collisions between them.

Figure 20:
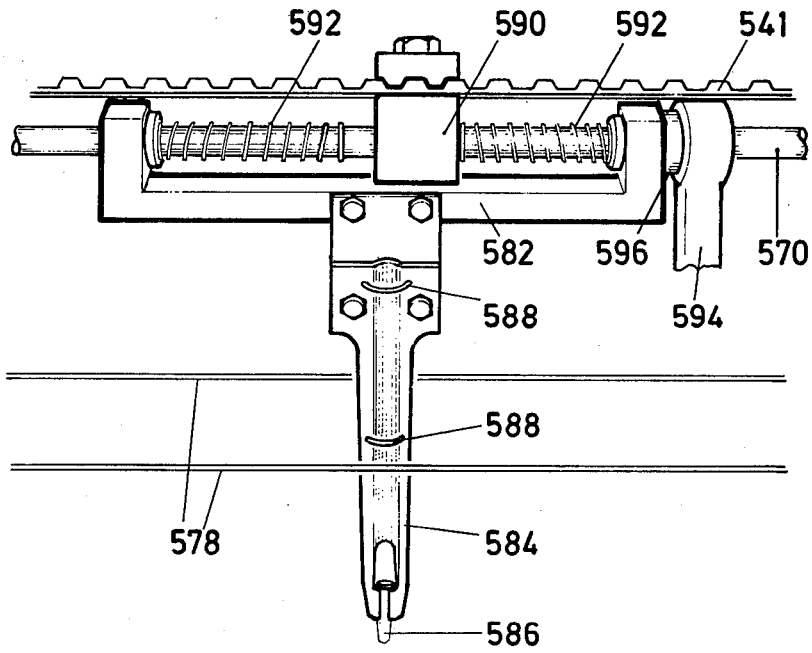
FIG. 20 is a perspective view of a yarn carrier of the knitting machine of FIG. 1 and FIG. 2.

The carriers 580 (See FIG. 20) each comprise a body 582 sliding on the rail 570 at two spaced positions and having a depending carrier back 584 projecting between the wires 578. The carrier back 584 has a tube 586 and guide eyes 588 for yarn. The body 582 is connected to the respective belt 541 by a drive block 590 on the rod 570. The block 590 is spaced from the body 582 in the longitudinal direction of the rails 570 by compression springs 592.

The carrier guide rail assembly also mounts adjustable stops 594 for the carriers having associated therewith rubber bushes 596. The stops 594 are movable sideways by the aforementioned lead screws 409 in conjunction with the fashioning operation.

Overall Configuration

Figure 19:
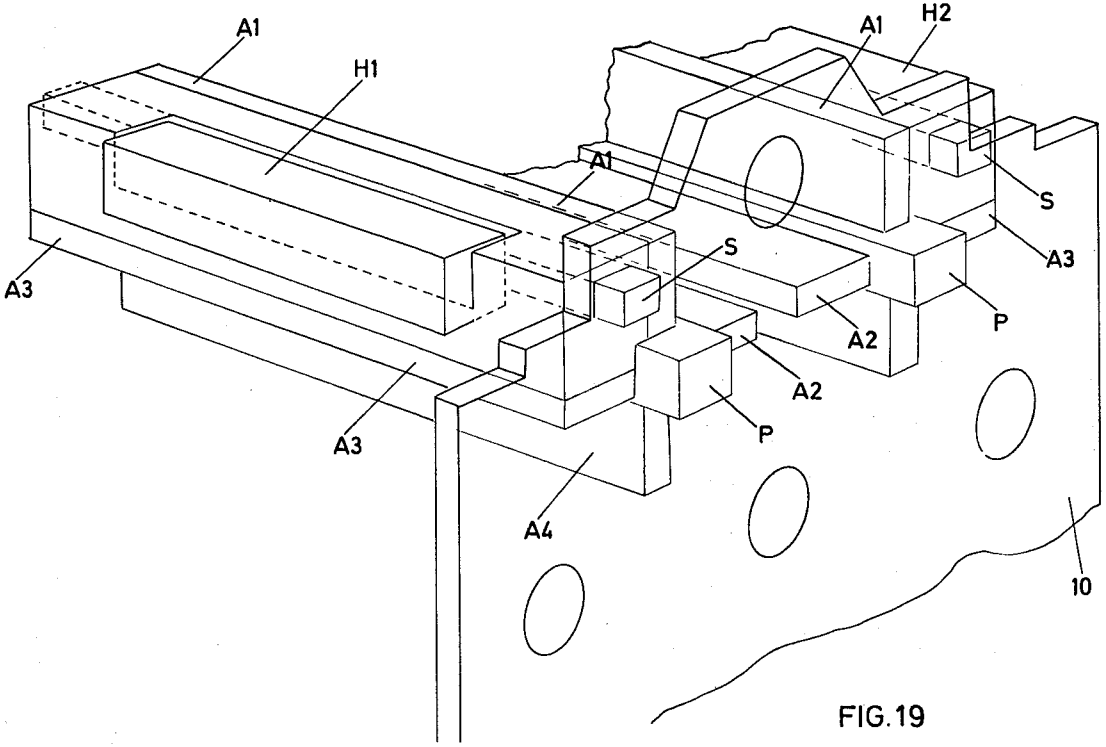
FIG. 19 is a perspective view in diagrammatic form of part of a knitting machine of the invention.

With reference now particularly to FIG. 1 and FIG. 19, it can be seen how the various levers have been arranged in an orderly and compact manner. The upright lever arms 86*a* to which various links or connecting arms 118 are connected form arrays A1 at each end behind the two knitting heads. The other lever arms 86*b* associated with the lever arms 86*a* form arrays A2 under the cam packs on the top cam shaft 48, the arrays A2 of the respective knitting heads overlapping. The sideways extending lever arms 86*a* to which various updown links 118 are connected form arrays at each end under the knitting heads. The other lever arms 86*b* associated therewith form arrays behind the bottom cam shaft 52 under the top cam shaft 48.

The lever arms in the arrays operate in a narrow longitudinally extending space between the end standards 10 and the various components of the knitting heads fit in front of and above the arrays lever arms.

The transmission of movement from the cam packs to the links 118 is generally direct and the reciprocating masses are small. The knitting heads are at the front and rear of the machine.

With reference to FIG. 19, the area occupied by the knitting head is shown as $H_1$ on one side and $H_2$ on the other side. It can be seen how $H_1$ fits partly into the L-shaped space occupied by the various levers. The knitting heads can be reached by links at intermediate positions but only to the rear and bottom parts of the knitting head so as to leave an unobstructed area for receiving yarn from the traversing carriers for forming into fabric. The area occupied by the slurbar S extends through the rectangular apertures formed by the links and levers at the ends of the knitting head. The levers are pivoted in areas P arranged virtually diagonally opposite the fabric formation zone in the knitting heads $H_1$ and $H_2$. The fabric formation zone is above the knockover bits and between the needles and sinker bar.

FIG. 3 shows that the draw mechanism can be combined with the configuration described without appreciably increasing its size or interfering with different knitting or fashioning motions.

The knitting machine further contains a fabric take down mechanism which may be of conventional design and the cam shaft shogging mechanism described previously on the left hand side as seen in FIG. 1. Yarn is supplied preferably by a feed device adapted to provide yarn at low tension but capable of taking up slack at the end of a draw motion. A suitable device called "Air tensioner and take-up facility" is made and sold by Hosiery Equipment Ltd., of Leicester following a HATRA development. The yarn passes through the fashioning frame 402 and carrier guide rail assembly to the tubes 586 from bobbins (not shown) supported on rods 587 (See FIG. 3).

Operation of Knitting Machine

Many of the operations on the knitting machine follow the same lines as in conventional multi-section straight bar machines. The following description emphasizes mainly the details of operation which are a consequence of the invention.

In operation knit cycles will alternate with draw cycles and from time to time a fashioning cycle will take place.

Starting with the draw cycle (See FIG. 21), the yarn carrier 580 which is operative (the others are parked inactive with their belts 541 uncoupled from the shaft 540) is moving from right to left at say a "front" knitting head, whilst simultaneously another carrier is moving from left to right at a "rear" knitting head when seen from the front. The carrier 580 leads the slurcock 210 so that the yarn trailing from the carrier (shown in chain dotted line) firstly passes over the sinker noses (the extreme forward ends of which are shown in solid lines) in front of the sinker ribs shown in dotted lines and secondly is kinked between the needles (not shown) whose stems are slightly in front of the nibs (Stage a). At the end of the trasverse, whilst the slurcock 210 is still moving, the body 582 of the carrier 580 impacts with the bush 596 of the stops 594 whilst the block 590 compresses the spring 592 on the leading side (Stage b). The part 584 of the carrier 580 is thus stopped instantly, even though the belt 541 continues its travel. The pinion cage 520 is now moved by the rod 562 in such a way that whilst the slurcock 210 continues its traverse, the carrier 580 is held still (Stage c).

The slurcock 210 and carrier 580 will both come to rest in the middle of sinkers 218 as the draw mechanism is of the variable draw type and the description so far relates to a traverse at less than full width.

The draw cam 544 now comes to a sector in which the draw lever 502 is held stationary, and a knitting cycle can now take place. First the slurbar 234 is moved back by operating the lever carrying the slurbar mountings 233 and the catch bar 154 moves all remaining sinkers 218 on the side of those advanced by the slurcock outward from the sinker bar 180 between the needles with the catch bar 154 at an intermediate height. The catch bar 154 is lowered into the recess formed by the sinker butts so as to positively hold against the sinkers 218 for movement in either direction. The cams on the shafts 52 and 48 now cause the different lever arms 86*a* and 86*b* to move in proper synchronisation to give the chain dotted track in case of the needles and the dotted track (See FIG. 11) in case of the knockover bar 170 whilst the sinkers 218 move to and fro to provide the usual knitting cycle. The kinked loops of yarn are taken into the hooks of the needles, the needle bar 140 moves to press the beards against the sinker bar 180 and thereby against the needle stems, the old loop is knocked over the top of the needles aided by the motion of the knockover bar 170 and withdrawal of the sinkers 218. The needles then rise and are once again located in the draw position. The catch bar 154 is raised to the intermediate height to free the sinkers 218 for forward movement. During the knitting cycle, the various bars are positively controlled during their complex movement and vibration can be reduced even at high knitting speeds to acceptable levels.

Figure 21:
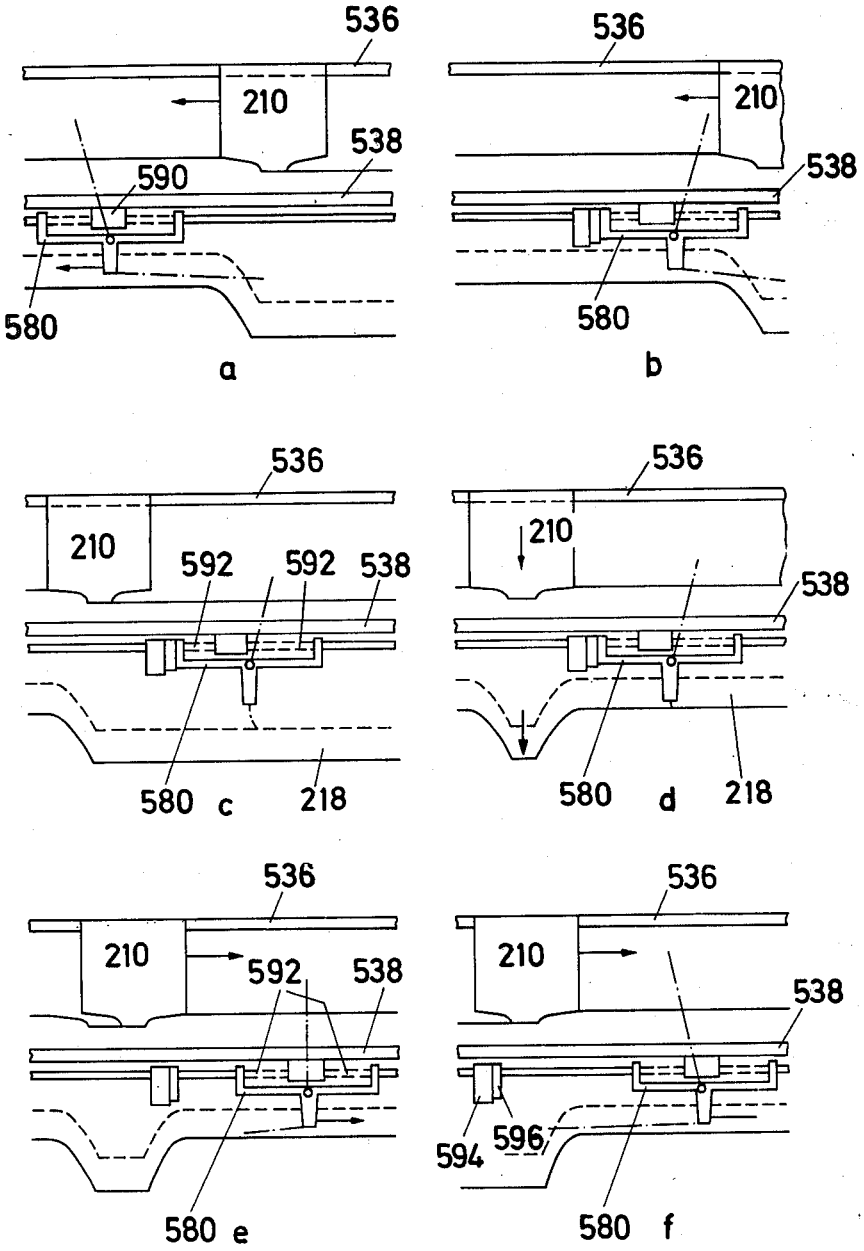
FIGS. 21(*a*) to (*f*) are plan views of the successive stages at the end and start of a slurcock/carrier traverse.

The next draw cycle from left to right in FIG. 21 can now commence. The slurbar 234 is moved forward projecting some sinkers 218 which are however devoid of yarn (Stage d). The draw lever 502 then commences to move whilst the carrier 580 remains in the same position (Stage e). As a result the slurcock 210 and the carrier 580 accelerate. The spring 592 relaxes and the slurcock and carrier traverse back with the carrier leading the slurcock as required (Stage f). The operation previously described is then repeated.

Figure 22:
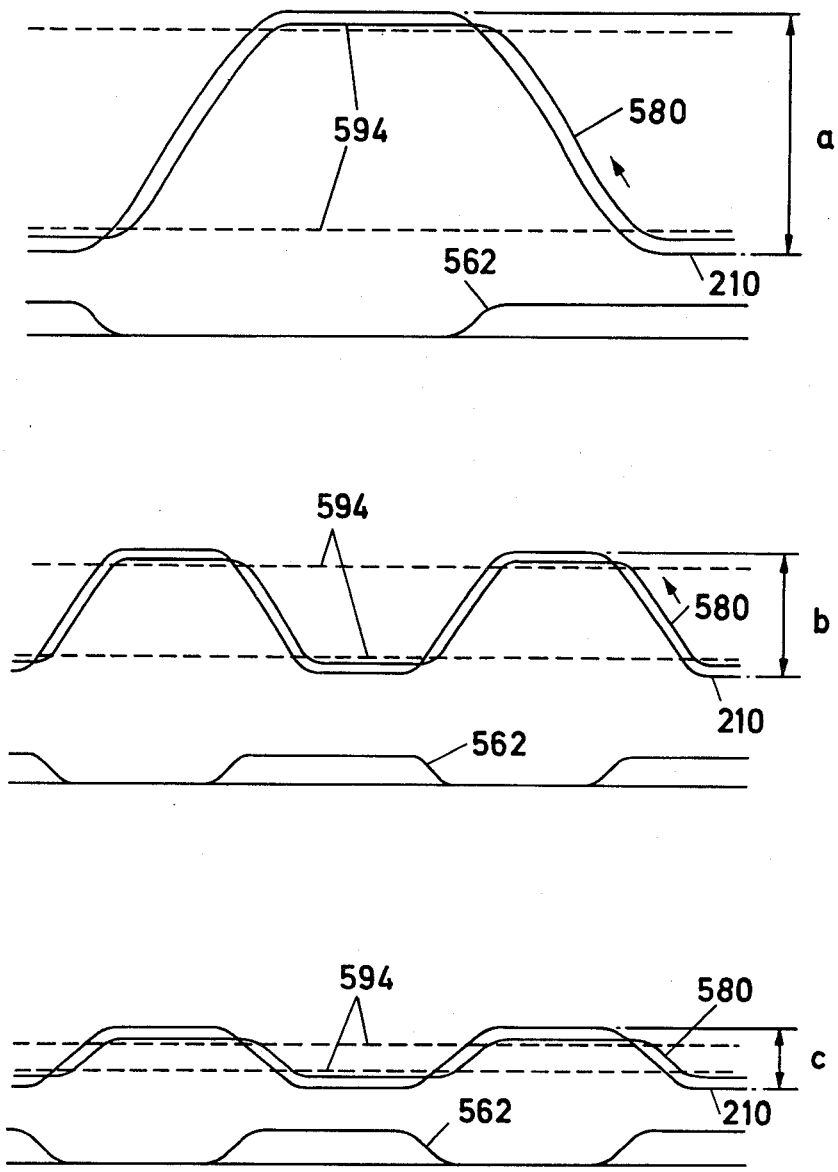
FIGS. 22(*a*) to (*c*) are timing diagrams of the slurcock/carrier traverse at different knitting widths.

FIG. 22 shows schematically the timing of the drawn motion. The vertical axis represents the draw width (shown in dotted lines). The horizontal axis represents time which moves from right to left. The arrow represents the direction of movement of the slurcock and yarn carrier. At a full draw width (FIG. 22*a*), the carrier 580 always travels in front of the slurcock 210 even though the extent of the slurcock traverse is greater. The motion of the pinion cage 520 is used to reverse the slurcock yarn carrier position at the end of each traverse. Whilst the drawing shows the actual slurcock movement, that of the yarn carrier is stopped by the stop 594 at the level of the dotted lines with the spring 592 compressed as described. FIG. 22*b* shows the arrangement at half draw width. The speed of the cam shaft rotations has been doubled so that there are twice as many draw motions for a given period. The slurcock-carrier speed is thus effectively unaltered but the knit cycle is performed near to its maximum speed. FIG. 22*c* shows the situation at "zero" draw width. The draw speed is reduced because the knit cycle has to be executed at a similar speed as previously.

The machine of the invention can thus be utilised to work: 1 near the maximum draw speed initially largely limited by the slurcock/jack impact whilst working below the maximum knit cycle speed when operating at full width and to work 2 near the maximum knit cycle speed at small draw width whilst working below the maximum draw speed.

Figure 23:
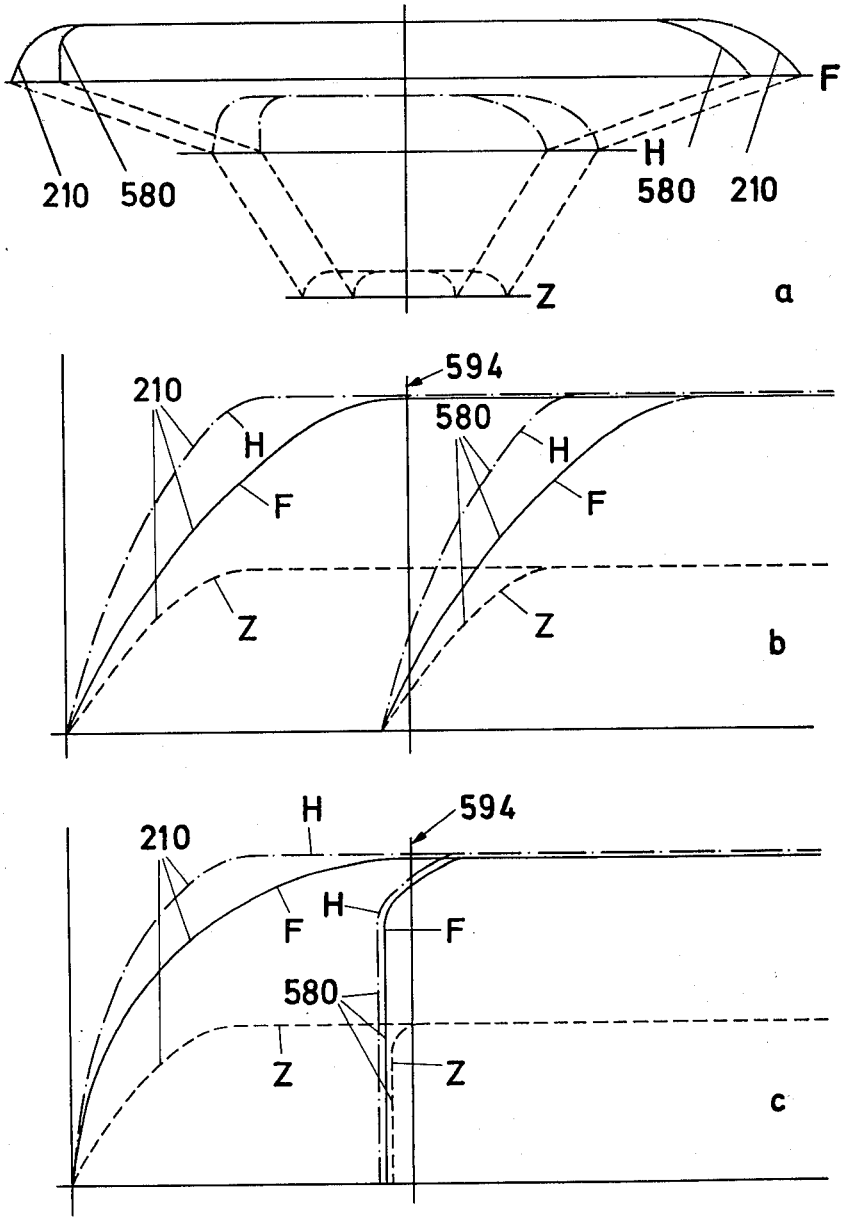
FIGS. 23(*a*) to (*c*) are velocity diagrams of the slurcock/carrier at different knitting widths.

The details of the velocity variations are illustrated in FIG. 23*a* to *c*. FIG. 23 a shows full draw width at F, half draw width at H and zero draw width at Z. The vertical axis represents speed. Moving from right to left it can be seen how the carrier 580 and its belt 541 decelerate suddenly as the carrier 180 meets the stop 594. The draw speed is unaltered at half draw width but reduced considerably at zero width.

With reference to FIG. 22*b*, this illustrates accelerations of the slurcock and yarn carrier drive belts at different draw widths. It can be seen that the yarn carrier only reaches full speed when well away from the stop 594 but this does not matter as knitting of yarn only starts when the slurcock moves past the stop by which time full speed has been reached. FIG. 22*c*, shows deceleration of the slurcock and yarn carrier belts at the end of the draw. The carrier 580 is slowed down marginally by the differential prior to meeting the stop and is then held against the stop as the belt travels on to a small extent. FIG. 22*b* and 22*c* shows the velocity of the slurcock 210 and its drive belt (which are the same). The carrier 580 stops at the solid vertical line representing the position of the stop 594. The cam controlling the pinion cage 520 is axially movable to vary the duration of the yarn carrier deceleration period relative to the overall draw motion. Without such axial shifting to bring up a different cam profile, the proportion of the draw lever motion during which the yarn carrier decelerates, would increase as the draw width reduces so interfering with proper yarn carrier movement.

Whilst knitting is in progress the fabric is taken down by a hook-up bar (not shown) biased to withdraw fabrics from the needles in the usual way.

To initiate fashioning, the clutch 62 (see FIG. 9) is shifted to prevent further rotation of the draw cam 544 and the cam shafts for the up-down and in-out motions are shogged to bring cam profiles appropriate to fashioning under the cam followers 114. Fashioning then takes place in the usual way. During carrier widening the pressure of the spring 592 which is compressed causes the yarn carrier 520 to follow the motion of the stop 594 controlled by a lead screw (not shown).

Modifications

The mechanism described may be modified as far as the needle bar movement mechanism is concerned by controlling each particular lever for movement in one sense by a cam on one cam shaft and for movement in another sense by a cam on another cam shaft. It is preferred however that the cams be on the same cam shaft since it facilitates accurate synchronisation of the cams. If lower speeds are acceptable it may be possible to move the levers by cams in one sense only and use a tension or preferably compression spring for return movement. The compression spring may be situated between two upright adjacent lever arms each serving one of the needle bars. In a more complicated drive arrangement levers with three arms could be employed two with cam followers for engaging their respective cams for to and fro movement of the levers and a third lever arm for operating the associated link. Using such levers it is possible to pull the needle bar in-out link by the operation of a cam below the knitting head.

The mechanism may also be adapted so that both needle bars can be operated from the same cams. This can be effected by intermediate pivotal linkages or by meshing gear sectors interconnecting the levers for the respective needle bars but in either event drive transmission is less direct and play may arise which inhibits high speed operation.

We claim:

1. Straight bar knitting machine having knitting instrumentalities, a plurality of elongate bars mounting the knitting instrumentalities, a longitudinally extending pivot area, levers for a predominant number of motions pivotably supported in the pivot area at one end to locate in a longitudinally extending substantially L-shaped zone links connected to the other end of the respective levers governing in-out and up-down motion of the respective bars to reciprocate them side-ways, a fabric formation zone defined by the area in which the respective bars reciprocate, said fabric formation zone, links, levers and pivot areas defining an approximately quadrangular configuration when seen from the side and the pivot area and the fabric formation zone being arranged diagonally opposite in the quadrangular configuration.

2. Straight bar knitting machine as claimed in claim 1 wherein a jack mechanism for sequentially advancing sinkers extends longitudinally of the respective bars along the rear of the fabric formation zone and a head rail mounting said jack mechanism is located between the fabric formation zone and the lever pivot area.

3. Straight bar knitting machine as claimed in claim 1 wherein a pair of longitudinally spaced needle bar up-down levers extend generally horizontally from the pivot area, a pair of longitudinally spaced needle bar in-out levers extend generally upright from the pivot area, upright support arms are pivotably connected at the ends of the up-down levers at lower ends of the arms, in-out links are pivotable connected at one end to the ends of in-out levers at the upper ends thereof and at the other end to the upper ends of the arms and a needle bar is connected at a position intermediate the ends of the arms to the arms to effect a combined up-down and in-out motion.

4. Straight bar knitting machine as claimed in claim 3 wherein a longitudinally extending flange is formed on the needle bar at a level adjacent the top thereof, guide plates are mounted on the knitting machine for confining the needle bar against lengthwise movement transversely of the direction of reciprocation of the needle bar and cams are mounted in the knitting machine to operate the upright in-out levers for the needle bar at least during reciprocatory movement of the needle bar into press.

5. Straight bar knitting machine as claimed in claim 1 in which an intermediate motion transmitting shaft extends at the fabric formation zone, intermediate links are mounted at one end eccentrically on the shaft a knockover bar is connected to the other ends of the intermediate links in-out and up-down levers extend from the pivot area, up-down links are connected at one end to the up-down levers and at the other end to the knockover bar, and in-out links are connected at one end to the in-out levers and at the other to the motion transmitting shaft.

6. Straight bar knitting machine as claimed in claim 5 in which members interconnect a sinker bar and a head rail at a plurality of spaced positions, bearings are formed in the members, the motion transmitting shaft is located by the bearings and at least one intermediate link interconnects the shaft and the knockover bar at a position spaced from the ends of the knockover bar.

7. Straight bar knitting machine as claimed in claim 1 which further includes a head rail a sinker bar mounted on the head rail and sinkers received in tricks in the sinker bar and in which a jack bar assembly is mounted on the head rail, a longitudinally extending slurbar is mounted behind the jack bar assembly, a pair of upright in-out levers support the slur bar at one end and are pivotably mounted in the pivot area of the other end, and a slurcock is mounted in the slurbar and in which further the jack assembly has a first set of jacks pivotably mounted to be engaged by the slurcock, a second set of jacks pivotably mounted to be engaged by the first set of jacks and to operate the sinkers.

8. Straight bar knitting machine as claimed in claim 7 in which the sinker advance is from 2.5 to 3.5 times the slurcock lift.

9. Straight bar knitting machine as claimed in claim 1 in which a first cam shaft for operating upright levers extending from the pivot area is arranged behind the said levers, and a second cam shaft for operating generally horizontal levers extending from the pivot area is arranged below the said horizontal levers.

10. Straight bar knitting machine as claimed in claim 9 in which the upright and horizontal levers in the L-shaped zone are part of bell-crank levers and cams on the respective first and second cam shafts reciprocate the levers positively in either direction.

11. Straight bar knitting machine as claimed in claim 1 in which a pair of fabric formation zones are provided, a pair of banks of upright levers are provided between the respective fabric formation zones, each bank extending from an associated pivot area, and a common cam shaft for operating both banks of upright levers is arranged between the respective banks.

12. Straight bar knitting machine as claimed in claim 11 in which a common drive shaft for the levers associated with each fabric formation zone is mounted below the common cam shaft and a reciprocable member is pivotably mounted on the machine for reciprocating in a plane at right angles to the common drive shaft, and a yarn carrier arrangement and slurcock arrangement is provided for each fabric formation zone operated by the reciprocable member.

* * * * *